US006295425B1

(12) United States Patent
Garcia et al.

(10) Patent No.: US 6,295,425 B1
(45) Date of Patent: Sep. 25, 2001

(54) SEAL ASSEMBLY FOR ELECTROGRAPHIC REPRODUCTION APPARATUS DEVELOPMENT STATION

(76) Inventors: Christopher Stephen Garcia, NexPress Solutions LLC, 1447 St. Paul St., Rochester, NY (US) 14653-7001; Kenneth Michael Patterson; Paul Essic Thompson, both of Heidelberg Digital, 901 Elmgrove Rd., Rochester, NY (US) 14653-6029; Blaise Philip Pelligra, Eastman Kodak Company, 901 Elmgrove Rd., Rochester, NY (US) 14653-5105

( * ) Notice: Subject to any disclaimer, the term of this patent is extended or adjusted under 35 U.S.C. 154(b) by 0 days.

(21) Appl. No.: 09/444,181

(22) Filed: Nov. 19, 1999

(51) Int. Cl.[7] ..... G03G 15/08
(52) U.S. Cl. ..... 399/103; 399/104
(58) Field of Search ..... 399/102–105

(56) References Cited

U.S. PATENT DOCUMENTS 5,267,007 * 11/1993 Watanabe et al. ..... 399/104
5,287,148 * 2/1994 Sakemi et al. ..... 399/104
5,450,169 * 9/1995 Hart et al. ..... 399/104
5,552,864 * 9/1996 Malicki et al. ..... 399/104
5,742,875 * 4/1998 Bogoshian et al. ..... 399/104
5,742,876 * 4/1998 Bogoshian ..... 399/104
5,946,530 * 8/1999 Tsuji et al. ..... 399/103

* cited by examiner

*Primary Examiner*—William J. Royer

(57) ABSTRACT

A seal assembly for preventing developer material from damaging the drive shaft bearing in an electrographic reproduction apparatus development station. The development station has a housing defining internal chambers for particulate developer material, a rotatable mixer located in a developer material reservoir chamber within the housing, a developer device for applying developer material to an electrostatic image to be developed, a rotatable transporting mechanism for moving developer material from the reservoir chamber to the developer device, and at least one drive shaft, carried in a bearing supported by the development station housing, for rotating the rotatable mixer, the rotatable transporting mechanism, and the developer device. The seal assembly includes a plurality of seal members associated with the drive shaft and extending progressively outwardly, in the direction of the longitudinal axis of the drive shaft, from the developer material housing chambers of the development station toward the bearing. At least one of the seal members rotates with the drive shaft while adjacent seal members remain stationary.

15 Claims, 4 Drawing Sheets

SEAL ASSEMBLY FOR ELECTROGRAPHIC REPRODUCTION APPARATUS DEVELOPMENT STATION

FIELD OF THE INVENTION

This invention relates in general to magnetic brush development stations for electrographic reproduction apparatus, and more particularly to a seal assembly for the magnetic brush development station.

BACKGROUND OF THE INVENTION

In typical commercial electrographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of development station commonly utilized in electrographic reproduction apparatus is the magnetic brush development station. The magnetic brush development station includes, a housing containing a plurality of elements and providing a reservoir for a supply of developer material. The developer material may be, for example, two-component material comprising magnetic carrier particles and relatively smaller pigmented marking particles. Included in the elements of the development station, a mixer assembly, such as a paddle wheel, auger or ribbon blender, is located in the reservoir and serves to stir the carrier particles and marking particles to triboelectrically charge the particles so that the marking particles adhere to the surface of the carrier particles. A transport mechanism brings the developer material from the reservoir into the field of a plurality of magnets within a rotating sleeve, commonly referred to as the toning roller (of course, the magnets could rotate and the sleeve remain stationary or rotate with a different angular velocity from the magnets). The rotating sleeve and magnetic fields cause the marking particles to be brought into the vicinity of the latent image charge patterns on the dielectric support member to be applied to the latent image charge patterns in order to develop such patterns (see, for example, U.S. Pat. No. 4,887,132, issued Dec. 12, 1989, in the names of Joseph, et al).

As will be appreciated, the respective drive shafts for the mixer assembly and transport mechanism of the electrographic reproduction apparatus development station run through the development station and are supported in bearings in the development station housing walls. While the bearings are generally protected by seals, due to the nature of the developer material, known seal arrangements have not been totally effective in protecting the bearings. The minute particle size of the development material enables the developer material to migrate through the seals into the bearings causing premature bearing life failure.

SUMMARY OF THE INVENTION

In view of the above, this invention is directed to a seal assembly for an electrographic reproduction apparatus development station wherein such seal assembly substantially prevents undesirable developer material migration into the development station bearing structure. The development station has a housing defining internal chambers for particulate developer material, a rotatable mixer located in a developer material reservoir chamber within the housing, a developer device for applying developer material to an electrostatic image to be developed, a rotatable transport mechanism for moving developer material from the reservoir chamber to the developer device, and at least one drive shaft, carried in a bearing supported by the development station housing, for rotating the rotatable mixer, the rotatable transport mechanism, and the developer device. The seal assembly includes a plurality of seal members associated with the drive shaft and extending progressively outwardly, in the direction of the longitudinal axis of the drive shaft, from the developer material housing chambers of the development station toward the bearing. At least one of the seal members rotates with the drive shaft while adjacent seal members remain stationary.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
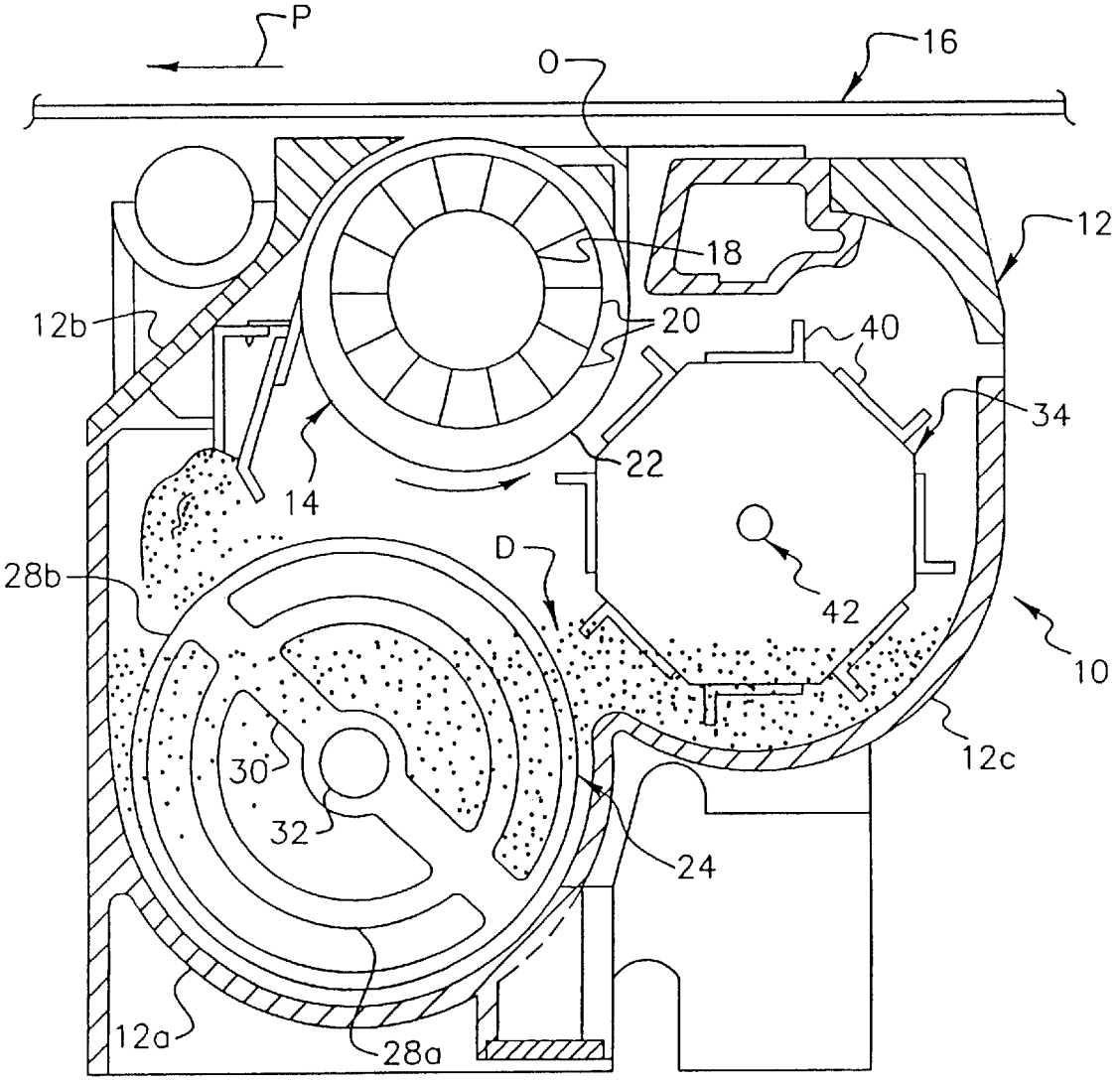
FIG. 1 is a side elevational view, partly in cross-section, of an electrographic reproduction apparatus magnetic brush development station, with portions removed or broken away to facilitate viewing.

Referring now to the accompanying drawings, FIG. 1 shows an exemplary electrographic reproduction apparatus development station, designated generally by the numeral 10, of the magnetic brush type. Although this development station is suitable for use with the invention described below, other development station configurations may similarly be employed. The magnetic brush development station 10 includes a housing 12 defining intercommunicating chamber-forming portions 12*a*–12*c*, including a lower portion 12*a* which serves as a reservoir for developer material D. The developer material is for example, a two-component material having magnetic carrier particles intermixed with relatively smaller pigmented marking particles. The upper portion 12*b* of the housing 12 contains a toning roller 14 for applying the marking particles to charge patterns formed on a dielectric support member 16 moving along a path P in juxtaposition to an opening O in the upper housing portion 12*b*.

The toning roller 14 of the magnetic brush development station 10 includes a core 18 having a plurality of magnets 20 spaced around the peripheral surface of the core. A non-magnetic substantially cylindrical shell 22 surrounds the core 18 and has its longitudinal axis offset from the longitudinal axis of the core. Such offset has the effect of decreasing the field strength of the magnets 20 over the area of the shell 22 spaced farther from the magnets so that the developer material has less propensity to adhere to the shell in that area and returns to the reservoir. As is well known in the art, the core and/or shell can be fixed or rotatable as long as the particular arrangement causes the developer material to move in the fields of the magnets 20 into contact with the dielectric support member 16. In the particular toning roller 14 illustrated in FIG. 1, the core 18 (and the magnets 20) rotates clockwise, while the shell 22 rotates counterclockwise. A latent image charge pattern of the dielectric support member 16 attracts marking particles from the developer material into adhering relationship with the charge pattern to develop such pattern. The developed pattern can then be subsequently transferred to a final receiver sheet and fixed thereto by heat and/or pressure, or may be fixed directly on the dielectric member, to form a desired reproduction.

Developer material D within the reservoir formed by the housing portion 12*a* is stirred by a mixer assembly 24. The mixer assembly 24 is for example a ribbon blender. The ribbon blender includes an inner helical ribbon 28*a* and an outer helical ribbon 28*b* connected by means of rods 30 to a shaft 32. The shaft 32 is supported, as more fully described below, relative to the housing 12 for rotation about the longitudinal axis fo such shaft. The pitch of the respective ribbons 28*s*, 28*b* are of opposite hands so that, as the shaft 32 rotates the ribbons, developer material is moved in opposite directions along the length of the blender, and the material is agitated to provide a triboelectric charge which causes the marking particles to adhere to the carrier particles. Of course, other types of mixers, such as paddle wheels or augers for example, are suitable for use with this invention.

The mixer assembly 24 also moves developer material radially with respect to the mixer so that the material is moved into the portion of the housing 12 designated by the numeral 12*c*. A transporting mechanism 34 is located within the housing portion 12*c*. The mechanism 34 includes a plurality of pickup members 40 mounted on a shaft 42 for rotation therewith. The shaft 42 is supported, as more fully described below, relative to the housing 12 for rotation about the longitudinal axis of such shaft. The pickup members 49 serve to transport developer material into the field of the magnets 20 of the toning roller 14. The pickup members 40 are for example in the general shape of buckets which, upon rotation of the shaft 42, are moved through the developer material where they pick up developer material. At that point in time when the pickup members 40 respectively pass the top dead center position for the mechanism 34, the developer material is urged by gravitational forces to fall from the pickup members. Since the falling developer material is in the magnetic field of the magnets 20 of the toning roller 14, the material is readily attracted to the shell 22 of the toning roller. The developer material is then moved by the toning roller 14 into applying relation with the charge pattern bearing dielectric support member 16 in the well known manner to develop a latent image charge pattern on such member.

Figure 2:
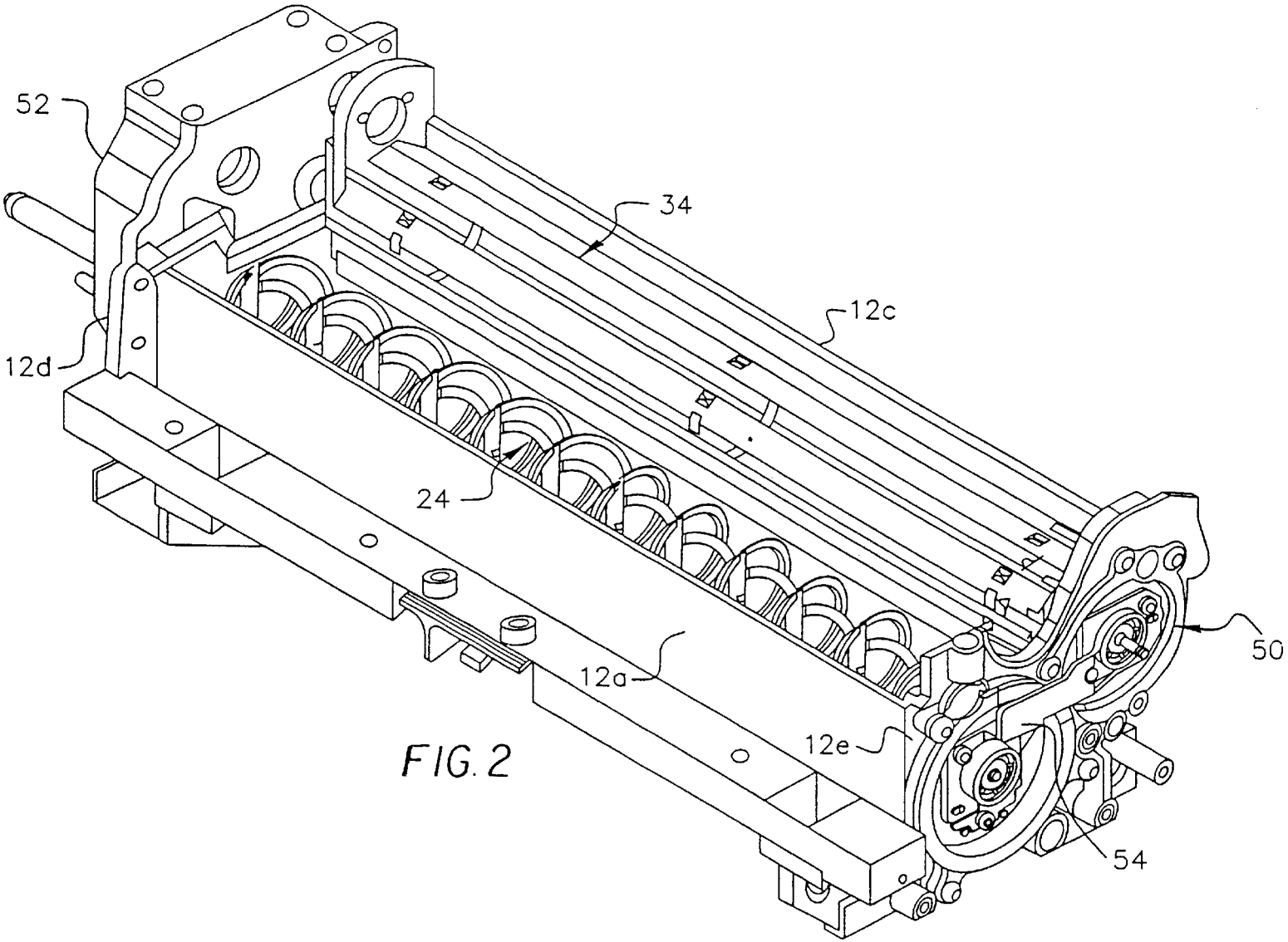
FIG. 2 is a view, in perspective, of an electrographic reproduction apparatus magnetic brush development station, including the adjustment mechanism according to this invention, with portions removed to facilitate viewing.

An adjustment mechanism, designated generally by the numeral 50, is provided to locate the shaft 32 for the ribbon blender of the mixer assembly 24 at a fixed horizontal distance from the interior wall of the reservoir portion 12*a* of the development station housing 12, and maintain the shaft 32 parallel to the shaft 42 of the transporting mechanism 34. The adjustment mechanism 50 (see FIG. 2) has been constructed so as to locate the ribbon blender of the mixer assembly 24 and buckets of the transporting mechanism 34 by using the location of the gearbox 52 at the rear end 12*d* of the developer station housing 12 to support respective one ends of the shafts, and the location of a bearing cap assembly 54 at the front end 12*e* of the housing to support the respective other ends of the shafts.

Figure 3:
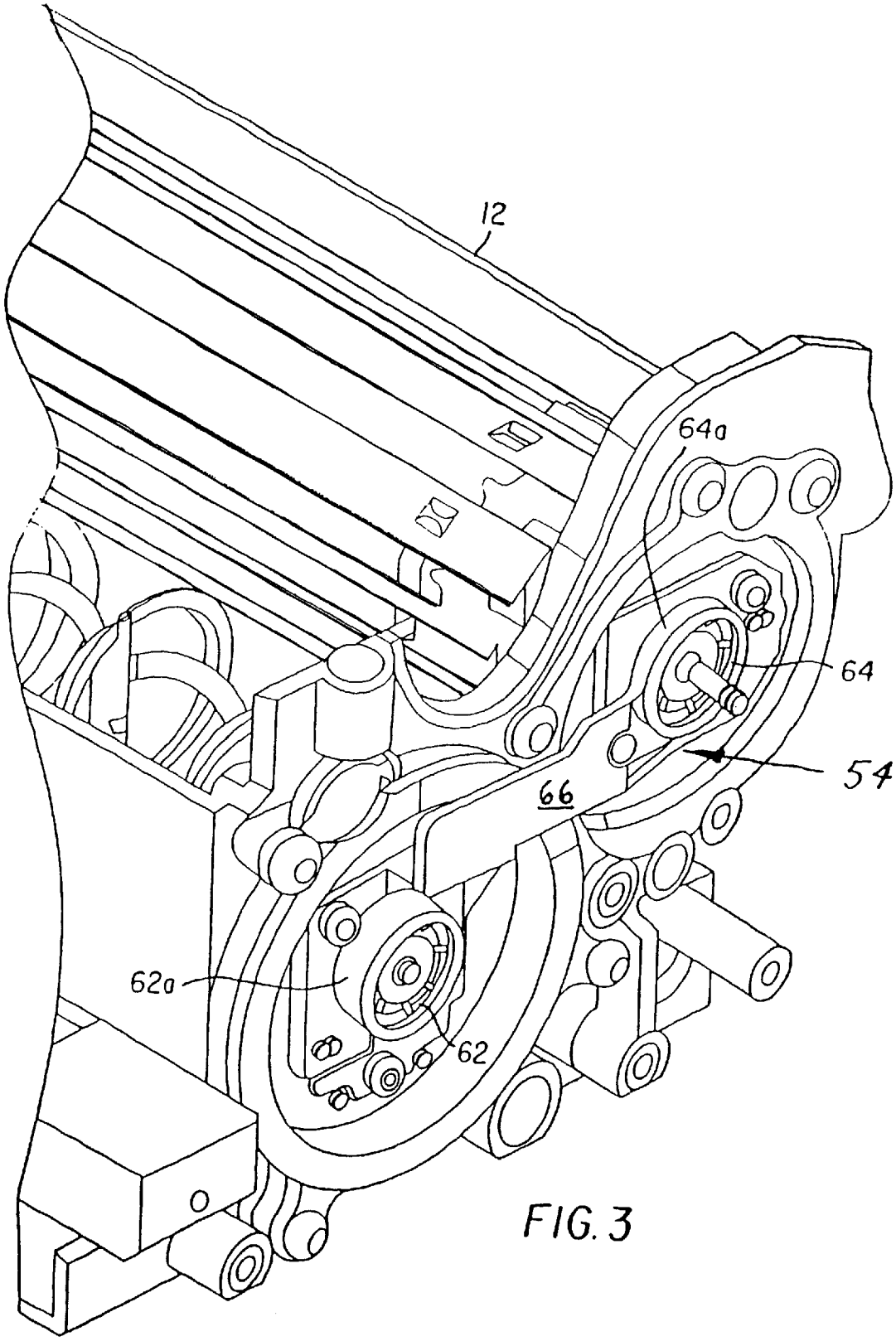
FIG. 3 is a view, in perspective and on an enlarged scale, of the electrographic reproduction apparatus magnetic brush development station and a portion of the adjustment mechanism according to this invention.

For locating the bearing cap assembly 54, for example at the front of development station housing 12, two bearings 62, 64 are housed in the bearing cap assembly (best shown in FIG. 3). The bearing cap assembly 54 includes a pair of bearing supports 62*a*, 64*a* for respectively supporting the bearings 62, 64. The bearings 62 and 64, in turn, respectively support ends of the shafts 32 and 42. A spacer member, such as for example an arm 66, rigidly connects the bearing supports 62*a*, 64*a*. The configuration of the spacer arm 66 is preselected to provide a set spacing between the bearings supports 62*a*, 64*a*. Thus, the longitudinal axes of the mixer assembly shaft 32 and the transporting mechanism shaft 42 are maintained a fixed distance apart. The distances between the bearings 62, 64, both horizontally and vertically, are matched to the same distances between the mixer assembly and transporting mechanism output drives in the gearbox 52 to keep the mixer assembly shaft 32 and the transporting mechanism shaft 42 in parallel orientation.

As noted above, it has been found that typical, well known, bearing seal arrangements do not sufficiently protect the bearings in the environment of the electrographic reproduction apparatus development stations. As discussed above, the small particles of the developer material migrate through the prior known seal arrangements and damage the bearings and cause early life failure. Accordingly, this invention provides a new seal assembly, designated generally by the numeral 70, which more effectively serves to prevent damage to the bearings for the drive shafts of the reproduction apparatus development station. The seal assembly 70 includes a plurality of interrelated seal members, arranged as a labyrinth, located within a cavity in the development station housing, between the bearings and the exposed developer material within the housing. The interrelated plurality of seal members provide redundancy by creating multiple, substantially aligned sealing points. Some of the seal members are arranged to rotate with the associated shaft, while other of the seal members remain stationary.

Figure 4:
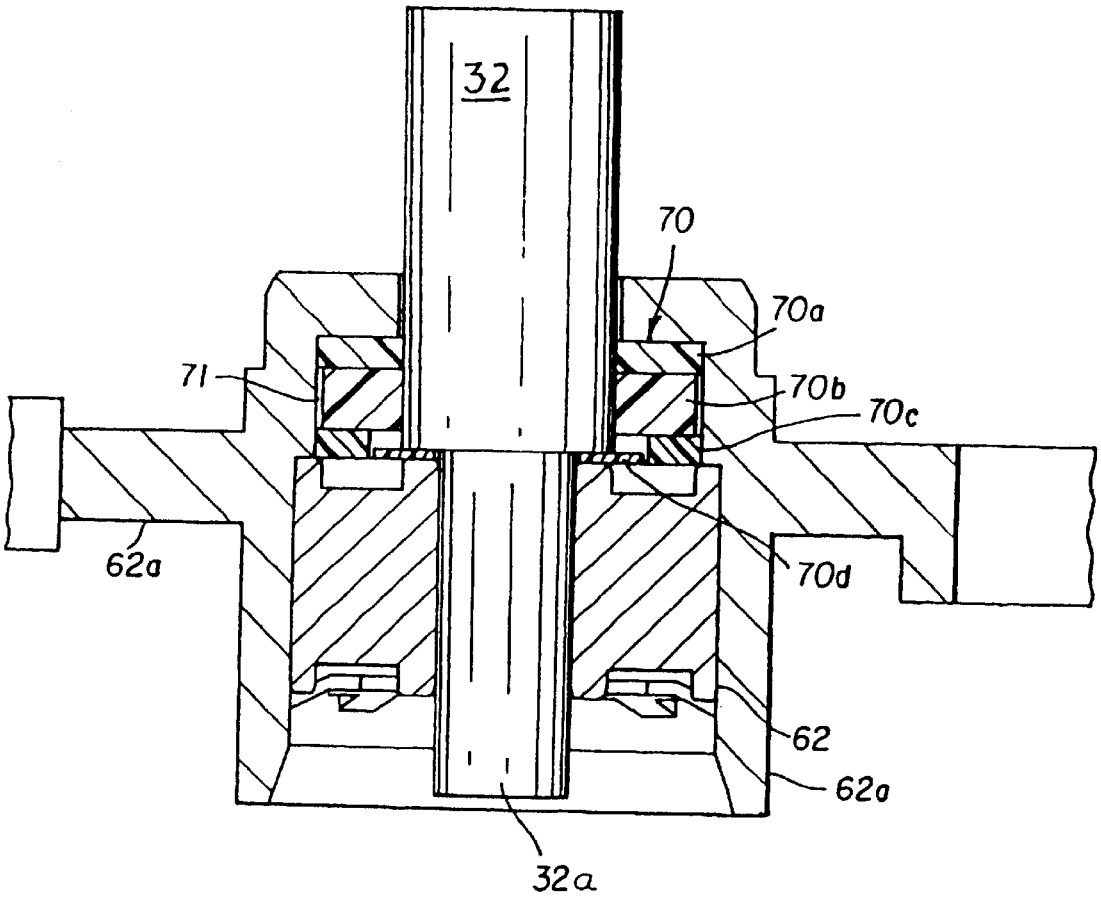
FIG. 4 is a top plan view, in cross-section and on an enlarged scale of a portion of the electrographic reproduction apparatus magnetic brush development station, including the seal assembly according to this invention.

Specifically, in the preferred embodiment best shown in FIG. 4, the seal assembly 70 has four seal members 70*a*–70*d* in the cavity 71. Of course, other numbers of seal members are suitable for use with this invention as long as the desired labyrinth is formed. The seal assembly 70 is shown as related to the mixer assembly shaft 32, supported in the bearing 62 carried by the bearing support 62*a*, but may of course similarly be associated with the other shafts of the development station 10, such as for example, the transport mechanism shaft 42.

The first seal member 70*a* is located, in the direction of the longitudinal axis of the associated shaft 32, closest to the chambers within the development station housing 12 for the developer material. The remainder of the individual seal members of the seal assembly 70 are located along the longitudinal axis of the shaft 32 progressively away from the developer material chambers and form a labyrinth.

The first seal member 70*a* has a slight clearance with respect to the shaft 32 so as to remain stationary in the bearing support 62*a* while the shaft rotates. The second seal member 70*b* has an interference fit with the shaft 32 so as to rotate with the shaft 32. Thereafter, the third seal member 70*c* has a clearance with respect to the shaft 32 to remain stationary with respect to the bearing support 62*a*, and the fourth seal member 70*d* is located on the stepped-down portion 32*a* of the shaft 32 and is sandwiched by the shoulder of the shaft and the bearing 62. Since the second seal member 70*b* rotates with the shaft 32 while the seal members 70*a* and 70*c* remain stationary, the two faces of the seal member 70*b* will slide between the first seal member 70*a* and the third seal member 70*c*, but maintain contact with the first and third seal members to substantially prevent developer material from passing through. The seal members 70*a*–70*d* are made of any suitable material, such as silicon-filled PTFE or graphite-filled PTFE for example. Moreover at least seal members 70*a*, 70*b*, and 70*c* are made of a material that has a low coefficient of friction (e.g., COF in the range of about 0.15 to 0.35), thus reducing friction and heat generation as the seal members rotate relative to one another. The fourth seal member 70*d* is provided to prevent any developer material that may possibly have gotten by the first group of seal members from getting near the inner race and seal interface of the bearing 62. Accordingly, the new seal assembly 70, according to this invention, has been found to significantly increase bearing life with no adverse effects thereon.

The seal interface of the bearing 62 is the point where material could potentially enter the bearing. However developer material trapped in the labyrinth of the seal assembly 70 reduces the pressure from new developer material entering the seal cavity. Thus, the developer material becomes a further sealing element. As will be appreciated then, the seal assembly 70 not only serves to prevent contamination of the bearing 62, but it will also serve the purpose of substantially preventing bearing grease from migrating back into the developer station housing 12 and potentially contaminating the developer material within the housing.

The invention has been described in detail with particular reference to certain preferred embodiment thereof, but it will be understood that variations and modifications can be effected within the spirit and scope of the invention.

What is claimed is:

1. In an electrographic reproduction apparatus development station including a housing defining at least one internal chamber for particulate developer material, a rotatable mixer located in a developer material reservoir chamber within said housing, a developer device for applying developer material to an electrostatic image to be developed, a rotatable transport mechanism for moving developer material from said reservoir chamber to said developer device, and at least one drive shaft, carried in a bearing supported by said housing, for rotating said rotatable mixer, said rotatable transport mechanism, and said developer device, a seal assembly for preventing developer material from damaging said bearing, said seal assembly comprising:

a plurality of seal members associated with said at least one drive shaft and extending progressively outwardly, in the direction of the longitudinal axis of said at least one drive shaft, from said at least one internal chamber of said housing toward said bearing, at least one of said seal members rotating with said at least one drive shaft while adjacent seal members remain stationary.

2. The seal assembly according to claim 1 wherein said plurality of seal members comprise a first, second, and a third seal member and wherein, in the direction of progression for said plurality of seal members, said first and third seal members are stationary with respect to said housing, and said second seal member rotates with said drive shaft.

3. The seal assembly according to claim 2 wherein said first, second, and third seal members are of a low coefficient of friction so as to reduce friction and heat generation.

4. The seal assembly according to claim 3 wherein said coefficient of friction is in the range of about 0.15 to 0.35.

5. The seal assembly according to claim 3 wherein a fourth seal member is provided, in said direction of progression for said plurality of seal members, for preventing developer material passing through said first through third seal members from reaching said bearing.

6. In an electrographic reproduction apparatus development station including a housing defining at least one internal chamber for particulate developer material, a rotatable mixer located in a developer material reservoir chamber within said housing, a developer device for applying developer material to an electrostatic image to be developed, a rotatable transport mechanism for moving developer material from said reservoir chamber to said developer device, and a plurality of drive shafts, carried in a plurality of bearings respectively supported by said housing, for rotating said rotatable mixer, said rotatable transport mechanism, and said developer device, a seal assembly for preventing developer material from damaging said bearings, said seal assembly comprising:

in association with each of said drive shafts, a plurality of seal members forming a labyrinth extending progressively outwardly, in the direction of the longitudinal axis of said drive shaft, from said at least one internal chamber of said housing toward said bearing, at least one of said seal members rotating with said drive shaft while adjacent seal members remain stationary.

7. The seal assembly according to claim 6 wherein said plurality of seal members comprise a first, second, and a third seal member and wherein, in the direction of progression for said plurality of seal members, said first and third seal members are stationary with respect to said housing, said second seal member rotates with said drive shaft.

8. The seal assembly according to claim 7 wherein said first, second, and third seal members are of a low coefficient of friction so as to reduce friction and heat generation.

9. The seal assembly according to claim 8 wherein said coefficient of friction is in the range of about 0.15 to 0.35.

10. The seal assembly according to claim 8 wherein a fourth seal member is provided, in said direction of progression for said plurality of seal members, for preventing developer material passing through said first through third seal members from reaching said bearing.

11. An electrographic reproduction apparatus development station comprising:

a housing having walls defining an internal chamber, a portion of said chamber serving as a reservoir for developer material;

a mixer located in said reservoir within said housing, said mixer including a ribbon blender mounted on a rotatable shaft carried by bearings supported in said housing walls;

a developer device for applying developer material to an electrostatic image to be developed;

a transport mechanism for moving developer material from said reservoir to said developer device, said transport mechanism including a plurality of buckets mounted on a rotatable shaft carried by bearings supported in said housing walls;

a drive mechanism for rotating said rotatable shaft of said mixer, said rotatable shaft of said transport mechanism, and said developer device; and a seal assembly, in association with each of said shafts, forming a labyrinth for preventing developer material from damaging said bearings, said seal assembly including a plurality of seal members extending progressively outwardly, in the direction of the longitudinal axis of said shaft, from said internal chamber within said housing toward said bearing, at least one of said plurality of seal members rotating with said shaft while adjacent seal members remain stationary.

12. The seal assembly according to claim 11 wherein said plurality of seal members comprise a first, second, and a third seal member and wherein, in the direction of progression for said plurality of seal members, said first and third seal members are stationary with respect to said housing, and said second seal member rotates with said shaft.

13. The seal assembly according to claim 12 wherein said first, second, and third seal members are of a low coefficient of friction so as to reduce friction and heat generation.

14. The seal assembly according to claim 13 wherein said coefficient of friction is in the range of about 0.15 to 0.35.

15. The seal assembly according to claim 13 wherein a fourth seal member is provided, in said direction of progression for said plurality of seal members, for preventing developer material passing through said first through third seal members from reaching said bearing.

* * * * *